US011524513B2

(12) United States Patent
Aoyagi et al.

(10) Patent No.: US 11,524,513 B2
(45) Date of Patent: Dec. 13, 2022

(54) CONVEYANCE APPARATUS, IMAGE DEFECT DETECTION DEVICE, AND IMAGE FORMING SYSTEM

(71) Applicants: Kohta Aoyagi, Kanagawa (JP); Hideyo Makino, Tokyo (JP); Susumu Mikajiri, Tokyo (JP); Kimiharu Yamazaki, Kanagawa (JP); Yoshinari Onuma, Kanagawa (JP); Satoshi Nakayama, Kanagawa (JP)

(72) Inventors: Kohta Aoyagi, Kanagawa (JP); Hideyo Makino, Tokyo (JP); Susumu Mikajiri, Tokyo (JP); Kimiharu Yamazaki, Kanagawa (JP); Yoshinari Onuma, Kanagawa (JP); Satoshi Nakayama, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 2 days.

(21) Appl. No.: 16/928,166

(22) Filed: Jul. 14, 2020

(65) Prior Publication Data

US 2021/0016584 A1 Jan. 21, 2021

(30) Foreign Application Priority Data

Jul. 16, 2019 (JP) ..... JP2019-130991
May 22, 2020 (JP) ..... JP2020-089923

(51) Int. Cl.
*B41J 29/393* (2006.01)
*B41J 13/00* (2006.01)

(52) U.S. Cl.
CPC ..... *B41J 29/393* (2013.01); *B41J 13/0009* (2013.01)

(58) Field of Classification Search
CPC ..... B41J 11/07; B41J 29/393; B65H 5/062
See application file for complete search history.

(56) References Cited

U.S. PATENT DOCUMENTS 5,901,950 A * 5/1999 Kobayashi ..... B65H 5/062 271/3.24
8,919,912 B2 12/2014 Uchida
(Continued)

FOREIGN PATENT DOCUMENTS

EP 3546400 A1 10/2019
JP 2008-302659 12/2008
(Continued)

OTHER PUBLICATIONS

European Search Report; Application EP20186241; dated Jan. 13, 2021.
(Continued)

*Primary Examiner* — Lam S Nguyen
(74) *Attorney, Agent, or Firm* — Duft & Bornsen, PC

(57) ABSTRACT

A conveyance apparatus includes a plurality of conveyors and an image reader. The plurality of conveyors conveys a recording material. The image reader reads a pattern image on the recording material being conveyed. The conveyance apparatus further includes circuitry to control the image reader. The circuitry controls the image reader to read the pattern image on the recording material in a period including a timing at which a trailing edge of the recording material being conveyed by at least two of the plurality of conveyors exits an upstream conveyor among the at least two of the plurality of conveyors in a direction of conveyance of the recording material.

11 Claims, 11 Drawing Sheets

(56) References Cited

U.S. PATENT DOCUMENTS

| | | | | |
|---|---|---|---|---|
| 9,348,288 | B2 | 5/2016 | Kaneko et al. | |
| 2008/0030536 | A1* | 2/2008 | Furukawa | B41J 11/007 347/16 |
| 2008/0112020 | A1 | 5/2008 | Mikajiri | |
| 2010/0208306 | A1 | 8/2010 | Fukutome et al. | |
| 2013/0250377 | A1 | 9/2013 | Kitai et al. | |
| 2013/0250378 | A1 | 9/2013 | Kitai et al. | |
| 2018/0020108 | A1 | 1/2018 | Nakayama et al. | |
| 2019/0202648 | A1 | 7/2019 | Nakayama et al. | |

FOREIGN PATENT DOCUMENTS

| | | |
|---|---|---|
| JP | 2010-266624 | 11/2010 |
| JP | 2018-042161 | 3/2018 |
| JP | 2018-142845 | 9/2018 |

OTHER PUBLICATIONS

U.S. Appl. No. 16/814,254, filed Mar. 10, 2020 Kohta Aoyagi, et al.

* cited by examiner

CONVEYANCE APPARATUS, IMAGE DEFECT DETECTION DEVICE, AND IMAGE FORMING SYSTEM

CROSS-REFERENCE TO RELATED APPLICATIONS

This patent application is based on and claims priority pursuant to 35 U.S.C. § 119(a) to Japanese Patent Application Nos. 2019-130991, filed on Jul. 16, 2019 and 2020-089923, filed on May 22, 2020, in the Japan Patent Office, the entire disclosure of each of which is hereby incorporated by reference herein.

BACKGROUND

Technical Field

Embodiments of the present disclosure relate to a reading device, an image defect detection device, a conveyance apparatus, and an image forming system.

Description of the Related Art

There is known a reading device including an image reader that reads a pattern image on a recording material being conveyed.

SUMMARY

Embodiments of the present disclosure describe an improved conveyance apparatus that includes a plurality of conveyors and an image reader. The plurality of conveyors conveys a recording material. The image reader reads a pattern image on the recording material being conveyed. The conveyance apparatus further includes circuitry to control the image reader. The circuitry controls the image reader to read the pattern image on the recording material in a period including a timing at which a trailing edge of the recording material being conveyed by at least two of the plurality of conveyors exits an upstream conveyor among the at least two of the plurality of conveyors in a direction of conveyance of the recording material.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
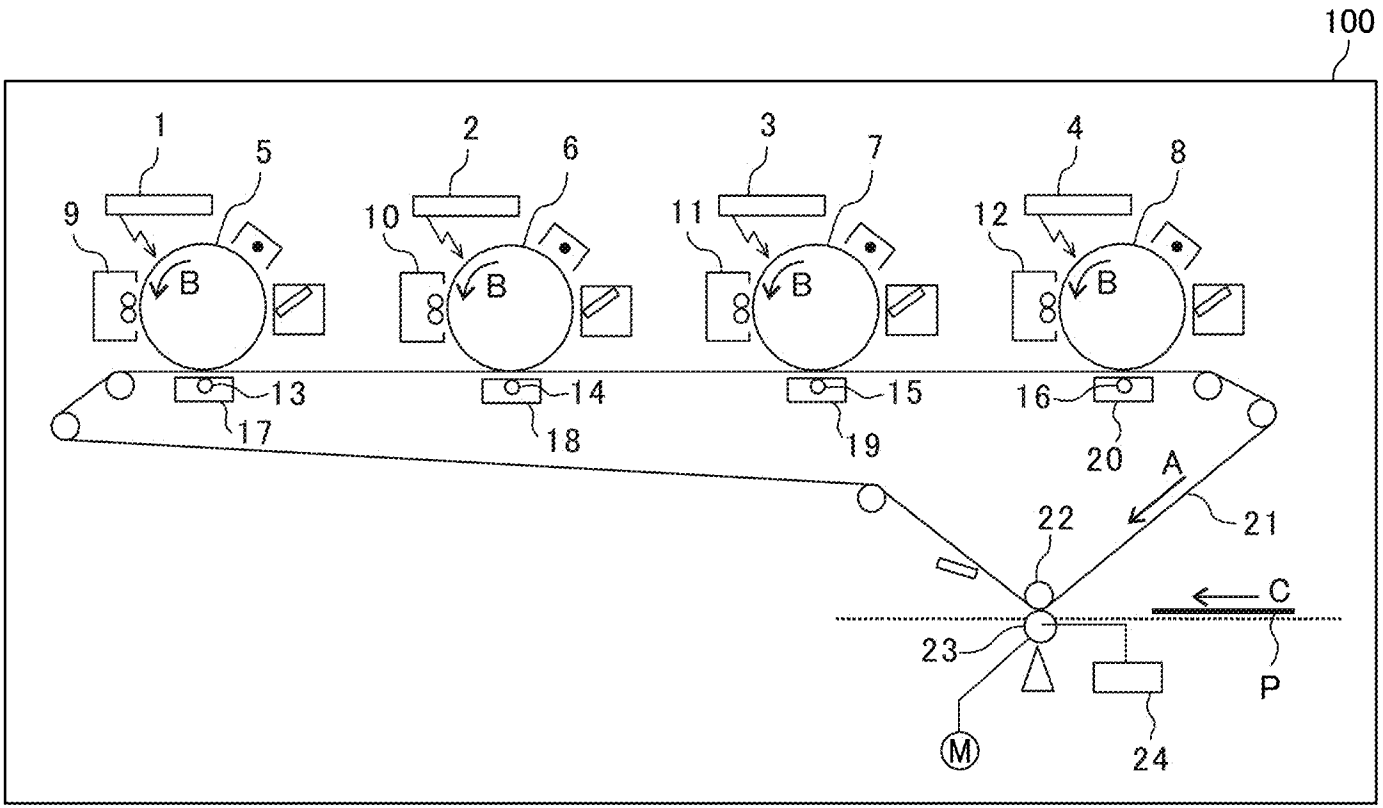
FIG. 1 is a schematic view illustrating a configuration of an image forming apparatus in an image forming system according to an embodiment of the present disclosure.

The accompanying drawings are intended to depict embodiments of the present disclosure and should not be interpreted to limit the scope thereof. The accompanying drawings are not to be considered as drawn to scale unless explicitly noted. In addition, identical or similar reference numerals designate identical or similar components throughout the several views.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

As used herein, the singular forms "a", "an", and "the" are intended to include the plural forms as well, unless the context clearly indicates otherwise.

An inkjet recording apparatus has been provided that forms a test pattern (pattern image) on a recording material (recording medium) in which a reading device reads the test pattern on the recording material with a reading sensor. In this inkjet recording apparatus, a conveyance error of a conveyance roller (conveyor) is detected based on read data of the test pattern read by the reading sensor, and the conveyance of the recording material is controlled by using a correction value for correcting the conveyance error.

However, if a conveyance speed of the recording material fluctuates abruptly and greatly while the reading sensor (image reader) reads a target image (the test pattern or the like) on the recording material being conveyed, the target image is not appropriately processed.

Figure 2:
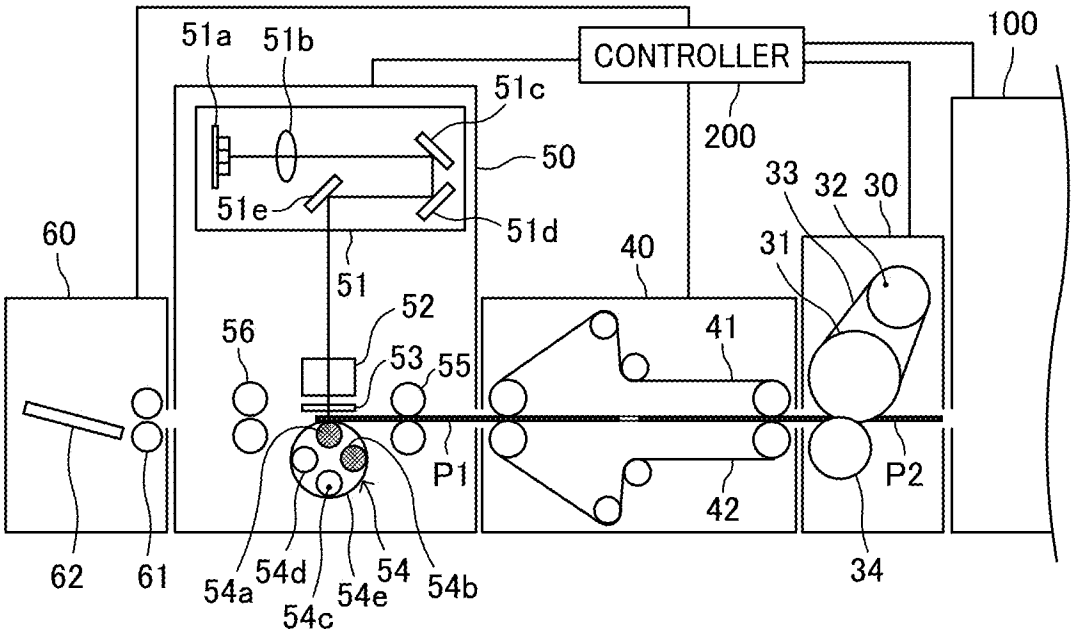
FIG. 2 is a schematic view illustrating a configuration of a fixing device, a cooling device, a reading device, and a sheet ejection device in the image forming system according to an embodiment of the present disclosure.

A description is given below of an image forming system according to an embodiment of the present disclosure. FIG. 1 is a schematic view illustrating a configuration of an image forming apparatus 100 in the image forming system according to the present embodiment. FIG. 2 is a schematic view illustrating a configuration of a conveyance apparatus of the image forming system according to the present embodiment.

The image forming system according to the present embodiment mainly includes a sheet feeding device, the image forming apparatus 100, a fixing device 30, a cooling device 40, a reading device 50, and a sheet ejection device 60 as illustrated in FIGS. 1 and 2. In this order, the above devices are arranged side by side along a direction of conveyance of a transfer sheet as a recording material (hereinafter, also referred to as a "conveyance direction"). Since each of these devices is modularized, the configuration of the image forming system is not limited to that of the present embodiment, and can exclude some devices, for example, the cooling device 40. In addition, for example, another device, such as a pre-treatment device disposed upstream from the image forming apparatus 100 in the conveyance direction, can be added to the image forming system. The pre-treatment device, for example, performs a pre-treatment of applying a desired liquid to the transfer sheet. Further, the arrangement order of the devices is not limited to the above-described order, for example, the cooling device 40 can be disposed downstream from the reading device 50.

As illustrated in FIG. 1, the multicolor image forming apparatus 100 according to the present embodiment employs a tandem, intermediate-transfer mechanism and includes an intermediate transfer belt 21 serving as an image bearer and an intermediate transferor, and the four photoconductors 5, 6, 7, and 8 serving as latent image bearers arranged side by side along the direction of rotation of the intermediate transfer belt 21. Note that the image forming apparatus is not limited to the above-described electrophotographic image forming apparatus 100, and image forming apparatuses of other types such as an inkjet type can be used.

In the image forming apparatus 100 according to the present embodiment, single-color toner images of cyan (C), magenta (M), yellow (Y), and black (K) formed on the four photoconductors 5, 6, 7, and 8 are superimposed on the surface of the intermediate transfer belt 21, thereby forming a multicolor toner image. Optical writing units 1, 2, 3, and 4 write electrostatic latent images on the surfaces of the four photoconductors 5, 6, 7, and 8, respectively. As the photoconductors 5, 6, 7, and 8 rotate in the direction indicated by arrow B in FIG. 1, the electrostatic latent images are transported to a development range opposite developing devices 9, 10, 11, and 12. The developing devices 9, 10, 11, and 12 deposit toners of respective colors on the electrostatic latent images on the photoconductors 5, 6, 7, and 8, thus rendering the electrostatic latent images visible as toner images.

The four photoconductors 5, 6, 7, and 8 contact the flat portion of the intermediate transfer belt 21 stretched around a plurality of support rollers and are arranged side by side along the direction of rotation of the intermediate transfer belt 21 indicated by arrow A in FIG. 1. Primary transfer rollers 13, 14, 15, and 16 are opposed to the back of the intermediate transfer belt 21 where the corresponding photoconductors 5, 6, 7, and 8 contact, and connected to high voltage power sources 17, 18, 19, and 20 to primarily transfer the toner images on the photoconductors 5, 6, 7, and 8 to the surface of the intermediate transfer belt 21. The toner images of respective colors on the photoconductors 5, 6, 7, and 8 are primarily transferred by the corresponding primary transfer rollers 13, 14, 15, and 16 and superimposed on the surface of the intermediate transfer belt 21, thereby forming the multicolor toner image.

The intermediate transfer belt 21 transports the multicolor toner image transferred thereto to a secondary transfer area while rotating. In the secondary transfer area, a secondary transfer backup roller 22, which is one of the support rollers, is disposed on the back side of the intermediate transfer belt 21, and a secondary transfer roller 23 is disposed on the front side of the intermediate transfer belt 21. The secondary transfer roller 23 is rotated by a drive motor M. The secondary transfer roller 23 can contact and separate from the surface of the intermediate transfer belt 21. In the image forming process, as illustrated in FIG. 1, the intermediate transfer belt 21 contacts the secondary transfer roller 23. A transfer sheet P as a recording material is conveyed to the secondary transfer area as indicated by arrow C in FIG. 1 and passes through the secondary transfer area while being nipped between the intermediate transfer belt 21 and the secondary transfer roller 23. At this time, a high voltage power source 24 applies a secondary transfer bias to the secondary transfer roller 23. As a result, the multicolor toner image on the surface of the intermediate transfer belt 21 is secondarily transferred onto the transfer sheet P conveyed by the secondary transfer roller 23.

As illustrated in FIG. 2, in the present embodiment, the conveyance apparatus includes the fixing device 30, the cooling device 40, the reading device 50, and the sheet ejection device 60. Devices that construct the conveyance apparatus can be set as required.

The transfer sheet P on which the toner image is transferred in the image forming apparatus 100 is conveyed to the fixing device 30. The fixing device 30 includes a fixing belt 33 and a pressure roller 34. The fixing belt 33 is rotated, while entrained around two rollers 31 and 32. The pressure roller 34 contacts the fixing belt 33, thereby forming a fixing nip therebetween. As the transfer sheet P conveyed from the image forming apparatus 100 enters and passes through the fixing nip, the toner image on the transfer sheet P is fixed on the transfer sheet P by heat from the fixing belt 33 and pressure of the fixing nip.

Subsequently, the transfer sheet P after the fixing process by the fixing device 30 is conveyed to the cooling device 40. The cooling device 40 includes two cooling belts 41 and 42, outer circumferences of which are opposed to each other to sandwich the transfer sheet P. The two cooling belts 41 and 42 are rotationally driven to convey the transfer sheet P downstream in the conveyance direction. While the transfer sheet P enters and passes between the two cooling belts 41 and 42, heat applied to the transfer sheet P during the fixing process is transferred through the two cooling belts 41 and 42 and dissipated. Thus, the heat of the transfer sheet P can be quickly removed.

The transfer sheet P after the cooling process by the cooling device 40 is then conveyed to the reading device 50. The reading device 50 includes a reading unit 51, an illumination unit 52, a platen glass 53, a background member 54, a first reading conveyance roller pair 55, and a second reading conveyance roller pair 56. The reading unit 51 constructs an image reader together with the illumination unit 52, the platen glass 53, and the background member 54 and reads a pattern image on the transfer sheet P being conveyed. The reading unit 51 includes an image sensor 51*a*, a lens 51*b*, mirrors 51*c*, 51*d*, and 51*e*, and the like to read an image on the transfer sheet P illuminated by the illumination unit 52. In FIG. 2, two transfer sheets P1 and P2 are depicted.

The platen glass 53 and the background member 54 are disposed in an illumination area illuminated by the illumination unit 52. The first reading conveyance roller pair 55 and the second reading conveyance roller pair 56 convey the transfer sheet P between the platen glass 53 and the background member 54. Illumination light from the illumination unit 52 is reflected by the transfer sheet P, passes through the platen glass 53, and enters the reading unit 51. The reading unit 51 starts reading an image with the image sensor 51*a* immediately before the leading edge of the transfer sheet P enters the illumination area, and finishes reading the image with the image sensor 51*a* immediately after the trailing edge of the transfer sheet P exits the illumination area. As a result, the reading unit 51 can read the image on the transfer sheet P and the outline of the transfer sheet P for each transfer sheet P.

The background member 54 of the reading device 50 according to the present embodiment includes a large-diameter black roller 54*a* having a black outer circumference, a small-diameter black roller 54*b* having a black outer circumference, a large-diameter white roller 54*c* having a white outer circumference, and a small-diameter white roller 54*d* having a white outer circumference (hereinafter, simply referred to as "rollers 54*a*, 54*b*, 54*c*, and 54*d*"). These four rollers 54*a*, 54*b*, 54*c*, and 54*d* are rotatably supported by a rotary support 54*e*. As the rotary support 54*e* rotates, one of the rollers 54*a*, 54*b*, 54*c*, and 54*d* is located at a position opposite the platen glass 53 in the illumination area. The background member 54 positions the corresponding one of the rollers 54*a*, 54*b*, 54*c*, and 54*d* at the position opposite the platen glass 53 depending on data of the transfer sheet P that identifies the thickness, the color, and the like of the transfer sheet P, and the operation mode of the image forming system (e.g., difference in conveyance speed).

The transfer sheet P that has passed through the reading device 50 is then conveyed to the sheet ejection device 60. The sheet ejection device 60 includes an output roller pair 61 that conveys the transfer sheet P conveyed from the reading device 50 to an output tray 62.

In the image forming system according to the present embodiment, various image defects may occur mainly due to the failure in the image forming apparatus 100. To detect such an image defect, in the present embodiment, the reading device 50 is provided, and a controller 200 including an image defect detector determines whether or not an image defect has occurred in an actual print image.

One example of the image defect is image density unevenness caused by a deviation of sub-scanning magnification error (fluctuation of sub-scanning magnification). The fluctuation of sub-scanning magnification may occur, for example, due to the eccentricity of the photoconductors 5, 6, 7, and 8, which causes the moving speed of the photoconductors 5, 6, 7, and 8 to fluctuate at respective positions for writing latent images. The fluctuation of sub-scanning magnification may also occur when the speed difference between the photoconductors 5, 6, 7, and 8, and the intermediate transfer belt 21 fluctuates in each primary transfer area, where the toner images are transferred from the photoconductors 5, 6, 7, and 8 to the intermediate transfer belt 21, due to the fluctuation of the moving speed of the photoconductors 5, 6, 7, and 8, or the intermediate transfer belt 21. Further, the fluctuation of sub-scanning magnification may occur when the speed difference between the toner image carried on the surface of the intermediate transfer belt 21 and the transfer sheet P fluctuates in the secondary transfer area.

The controller 200 determines whether or not an image defect has occurred based on read data of the print image received from the reading device 50. Specifically, the controller 200 compares a read image based on the read data with a master image of print data. In the present embodiment, the master image is an ideal image based on original image data when the print image is formed. Based on this comparison, the controller 200 determines whether or not the image defect has occurred.

In the image forming apparatus 100 according to the present embodiment, four colors of cyan (C), magenta (M), yellow (Y), and black (K) are used to represent the color of the print image on the transfer sheet P. Therefore, the original image data for forming the print image is created using a color model based on a CMYK color space. On the other hand, the reading unit 51 of the reading device 50 according to the present embodiment outputs the read data using a color model based on an RGB color space of three colors of red (R), green (G), and blue (B). Therefore, in order to appropriately compare the read image based on the read data and the master image of the print data (ideal image based on the original image data), it is necessary to match the CMYK color space and the RGB color space.

Therefore, the controller 200 according to the present embodiment converts the original image data in the CMYK color space used as the master image into image data in the RGB color space in which the read data is represented, and generates a master image in the RGB color space. A fixed parameter stored in advance in a memory of the controller 200 can be used as a conversion parameter for the conversion. Alternatively, the conversion parameter can be generated based on measured values measured in the present image forming system because an appropriate value varies depending on usage environment, characteristics of the transfer sheet P, or the like.

Figure 3A:
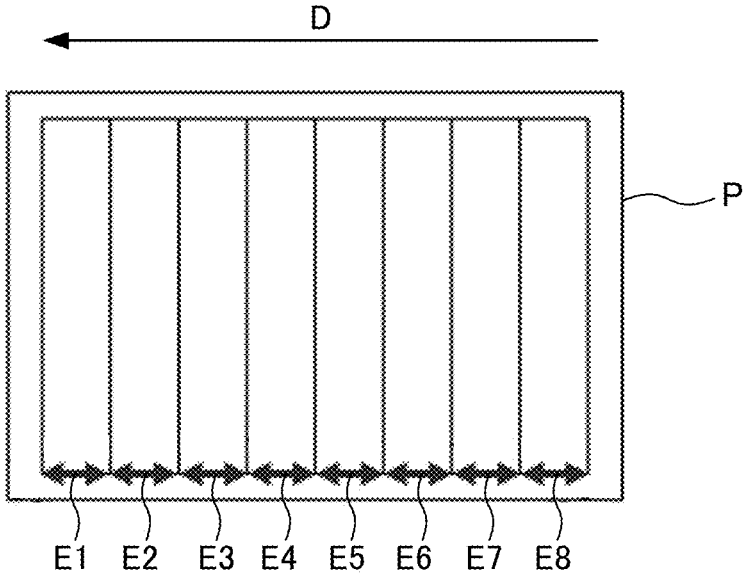
FIG. 3A is a schematic view illustrating an example of an ideal image (master image) represented on a transfer sheet based on an original image data of a print image according to an embodiment of the present disclosure.
Figure 3B:
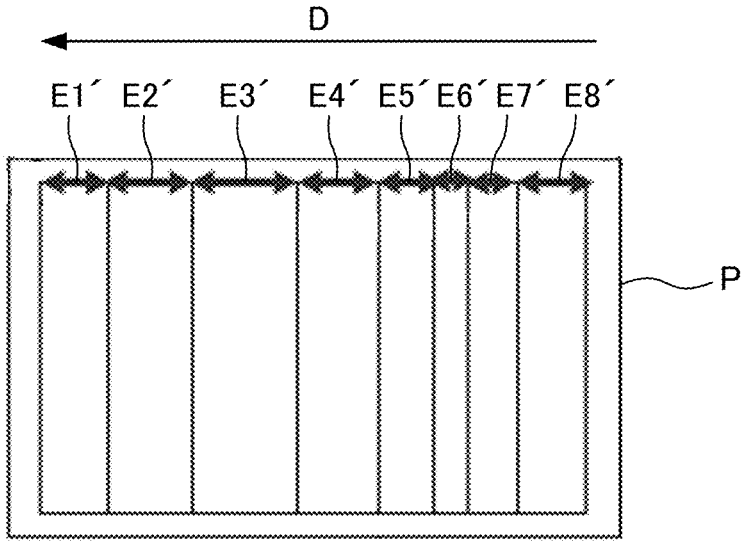
FIG. 3B is a schematic view illustrating an example of the print image actually formed on the transfer sheet when a fluctuation of sub-scanning magnification has occurred (when an image defect has occurred)

FIG. 3A is a schematic view illustrating an example of the ideal image (master image) based on the original image data of the print image represented on the transfer sheet P. FIG. 3B is a schematic view illustrating an example of the print image actually formed on the transfer sheet P when the fluctuation of the sub-scanning magnification has occurred (when the image defect has occurred).

As illustrated in FIG. 3A, the master image includes a pattern in which a plurality of lines extending in the main scanning direction are arranged at equal intervals in the sub-scanning direction (i.e., the conveyance direction indicated by arrow D in FIG. 3A). That is, in an ideal print image formed based on the original image data, line intervals E1 to E8 are all equal. Therefore, if the fluctuation of the sub-scanning magnification does not occur, even in the print image actually formed on the transfer sheet P based on the original image data, line intervals E1' to E8' are all equal.

However, when the fluctuation of the sub-scanning magnification occurs, in the print image formed on the transfer sheet P, the line intervals E1' to E8' are not equal as illustrated in FIG. 3B. Specifically, in the example illustrated in FIG. 3B, the line intervals E2' to E4' are wider than the ideal line intervals E2 to E4, and the line intervals E5' to E7' are narrower than the ideal line intervals E5 to E7. Thus, the controller 200 can determine whether or not an image defect, which is the fluctuation of the sub-scanning magnification, has occurred based on the read data from the reading device 50 because the reading device 50 appropriately reads the print image formed on the transfer sheet P when the fluctuation of the sub-scanning magnification occurs.

In image defect detection, for example, the controller 200 compares the read image based on the read data with the master image of the print data, determines the type of image defect based on the comparison result, and reports the determination result to a user. Then, the controller 200 prompts the user to eliminate the cause of the image defect. However, when an error of reading occurs in the reading device 50, the read data may include false data, and as a result, the controller 200 may erroneously determine that the image defect has occurred in the image defect detection.

Figure 4A:
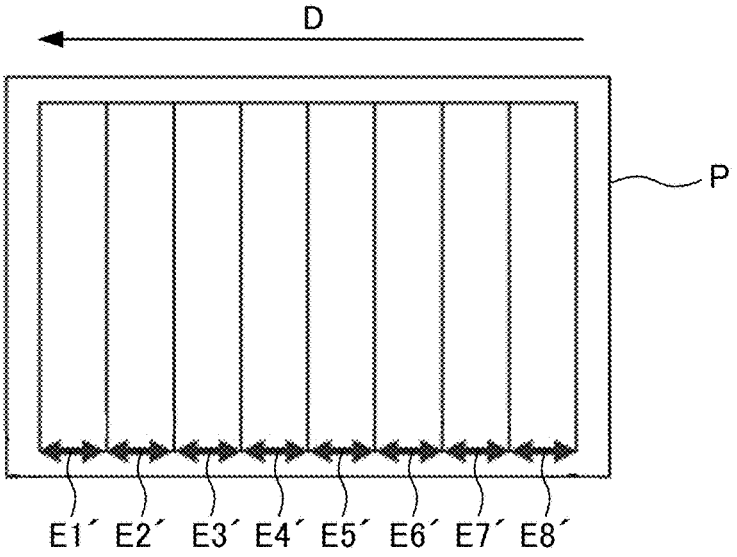
FIG. 4A is a schematic view illustrating an example in which the ideal image (master image) illustrated in FIG. 3A is actually formed on the transfer sheet when the fluctuation of the sub-scanning magnification does not occur.
Figure 4B:
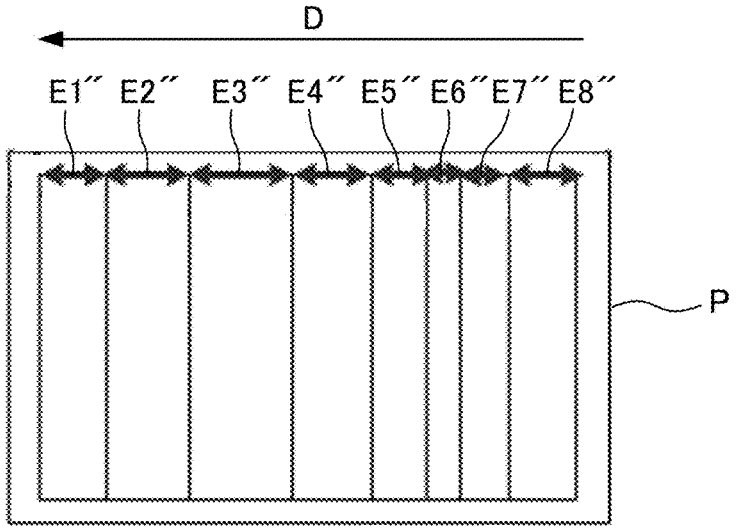
FIG. 4B is a schematic view illustrating an example in which a read image is represented on the transfer sheet based on read data obtained by the reading device, which reads the print image on the transfer sheet illustrated in FIG. 4A, according to an embodiment of the present disclosure.
Figure 4C:
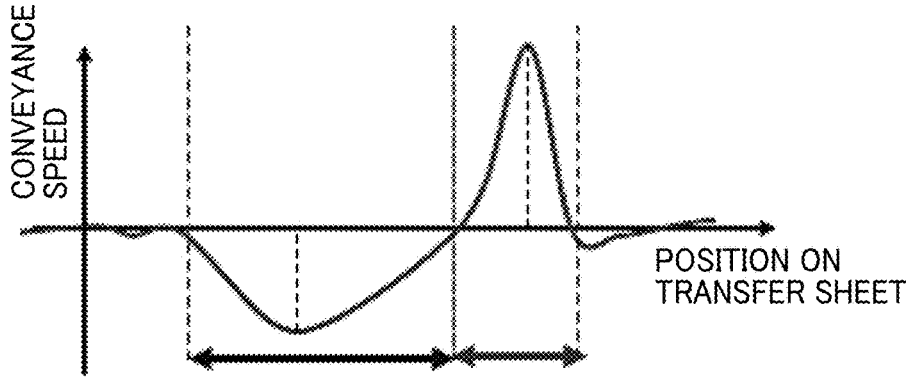
FIG. 4C is a graph illustrating a relation between a position in the sub-scanning direction on the transfer sheet P illustrated in FIG. 4B and a conveyance speed when the position in the sub-scanning direction passes through a reading area of the reading device.

FIG. 4A is a schematic view illustrating an example in which the ideal image (master image) illustrated in FIG. 3A is actually formed on the transfer sheet P when the fluctuation of the sub-scanning magnification does not occur. FIG. 4B is a schematic view illustrating an example in which the read image is represented on the transfer sheet P based on the read data obtained by the reading device 50, which reads the print image on the transfer sheet P illustrated in FIG. 4A. FIG. 4C is a graph illustrating a relation between a position in the sub-scanning direction on the transfer sheet P illustrated in FIG. 4B and the conveyance speed when the position in the sub-scanning direction passes through a reading area of the reading device 50.

When the fluctuation of the sub-scanning magnification does not occur, as illustrated in FIG. 4A, in the print image actually formed on the transfer sheet P, the line intervals E1' to E8' are all equal, similarly to the ideal image (master image) illustrated in FIG. 3A. However, when the transfer sheet P on which the print image is formed without the fluctuation of the sub-scanning magnification passes through the reading area of the reading device 50, if the conveyance speed of the transfer sheet P fluctuates as illustrated in FIG. 4C, line intervals E1" to E8" are not equal as illustrated in FIG. 4B in the read image indicated by the read data, resulting in the error of reading.

If the read image with line intervals E1" to E8" as illustrated in FIG. 4B is obtained from the read data due to the error of reading of the reading device 50, for example, the controller 200 determines that the line interval E3" exceeds a predetermined tolerance and may recognize that the image defect has occurred. For example, the controller 200 determines that the line interval E6" is out of the predetermined tolerance and may recognize that the image defect has occurred. If such a determination is made, although the fluctuation of the sub-scanning magnification does not actually occur as illustrated in FIG. 4A, and other image defects do not occur, the controller 200 may erroneously perform an image defect treatment due to the error of reading of the reading device 50.

The error of reading of the reading device 50 that causes the erroneous image defect treatment is mainly caused by the following reasons.

That is, while conveyed so as to pass through the reading area of the reading device 50, the transfer sheet P receives conveyance force and conveyance load from a plurality of conveyors, such as the fixing belt 33 and the pressure roller 34 as fixing conveyors of the fixing device 30, the cooling belts 41 and 42 as cooling conveyors of the cooling device 40, the first and second reading conveyance roller pairs 55 and 56 of the reading device 50, and the output roller pair 61 of the sheet ejection device 60. The conveyance force and the conveyance load received from the plurality of conveyors fluctuate greatly at the timing when the trailing edge of the transfer sheet P exits an upstream conveyor disposed on the upstream side of the transfer sheet P in the conveyance direction, or when the leading edge of the transfer sheet P enters a downstream conveyor disposed on the downstream side of the transfer sheet P in the conveyance direction.

For example, in FIG. 2, the conveyance force or the conveyance load by the cooling belts 41 and 42 of the cooling device 40, which is the upstream conveyor disposed on the upstream side of the transfer sheet P1 in the conveyance direction and the conveyance force or conveyance load by the first reading conveyance roller pair 55 of the reading device 50, which is the upstream conveyor disposed on the upstream side of the transfer sheet P1 in the conveyance direction, act on the transfer sheet P1 passing through the reading area. When the transfer sheet P1 is further conveyed, the leading edge of the transfer sheet P1 enters the second reading conveyance roller pair 56, which is the downstream conveyor disposed on the downstream side of the transfer sheet P1 in the conveyance direction. As a result, because the leading edge of the transfer sheet P1 contacts the second reading conveyance roller pair 56, an abrupt conveyance load is generated on the transfer sheet P1, or a conveyance force or a conveyance load by the second reading conveyance roller pair 56 is added to the transfer sheet P1. Therefore, the conveyance speed of the transfer sheet P1 fluctuates abruptly and greatly (i.e., an abrupt speed fluctuation occurs).

When the transfer sheet P1 is further conveyed, the trailing edge of the transfer sheet P1 exits the nip between the cooling belts 41 and 42, which are the upstream conveyor disposed on the upstream side of the transfer sheet P1 in the conveyance direction. As a result, the conveyance force or the conveyance load from the cooling belts 41 and 42 acting on the transfer sheet P1 abruptly disappears. Therefore, the conveyance speed of the transfer sheet P1 fluctuates abruptly and greatly.

As described above, while the transfer sheet P1 passes through the reading area of the reading device 50 (while the reading device 50 reads the print image on the transfer sheet P1), the conveyance speed of the transfer sheet P1 fluctuates abruptly and greatly at the timing at which the conveyors that apply the conveyance force or the conveyance load to the transfer sheet P1 are switched.

Further, the conveyance speed of the transfer sheet P1 fluctuates abruptly and greatly not only at the timing at which the conveyors are switched that apply the conveyance force or the conveyance load directly to the transfer sheet P1 passing through the reading area of the reading device 50, but also at the timing at which the conveyors are switched that simultaneously conveys the transfer sheets P1 and P2 and applies the conveyance force or the conveyance load to the transfer sheet P2.

Figure 5:
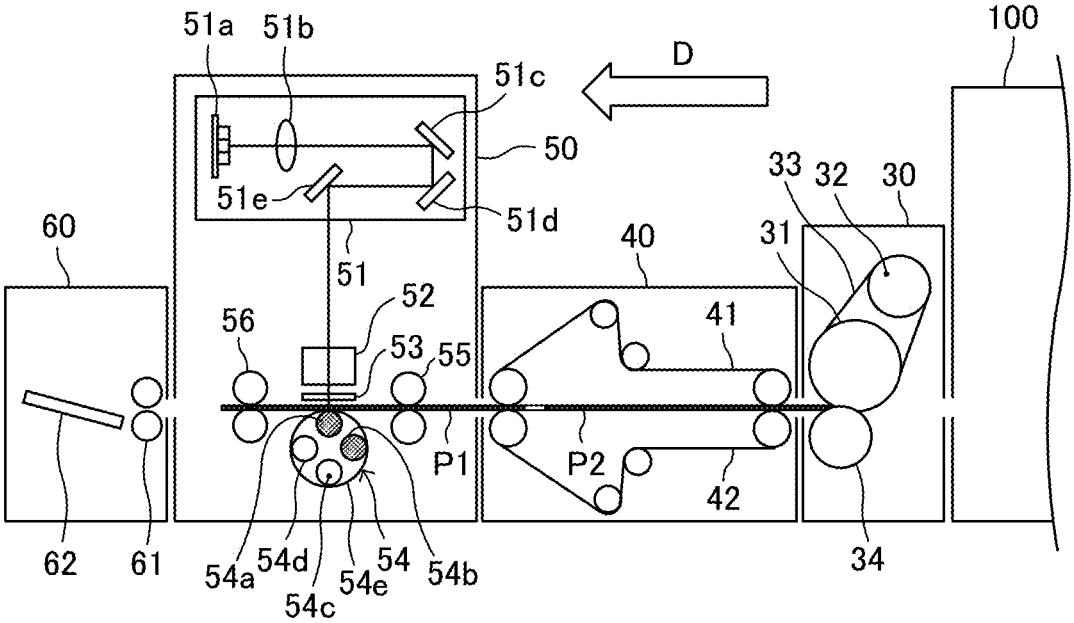
FIG. 5 is a schematic view illustrating the image forming system in which a plurality of transfer sheets is conveyed.

FIG. 5 is a schematic view illustrating the image forming system in which two transfer sheets P1 and P2 are conveyed.

When the cooling belts 41 and 42 convey the transfer sheet P1 passing through the reading area, the load applied to the cooling belts 41 and 42 greatly fluctuates at the timing at which the leading edge of the transfer sheet P2 being conveyed by the fixing belt 33 and the pressure roller 34 of the fixing device 30 enters the nip between the cooling belt 41 and 42 of the cooling device, which is the downstream conveyor disposed on the downstream side of the transfer sheet P2 in the conveyance direction. As a result, the conveyance force or the conveyance load applied to the transfer sheet P1 by the cooling belts 41 and 42 fluctuates, and the conveyance speed of the transfer sheet P1 fluctuates abruptly and greatly.

Further, as illustrated in FIG. 5, when the cooling belts 41 and 42 convey the transfer sheet P1 passing through the reading area and the transfer sheet P2 following the transfer sheet P1, the load applied to the cooling belts 41 and 42 greatly fluctuates at the timing at which the trailing edge of the transfer sheet P2 exits the nip between the fixing belt 33 and the pressure roller 34 of the fixing device 30, which is the upstream conveyor disposed on the upstream side of the transfer sheet P2 in the conveyance direction. As a result, the conveyance force or the conveyance load applied to the transfer sheet P1 by the cooling belts 41 and 42 fluctuates, and the conveyance speed of the transfer sheet P1 fluctuates abruptly and greatly.

That is, the conveyance speed of the transfer sheet P1 fluctuates when the conveyance force or the conveyance load of the conveyors that convey the transfer sheet P1 are affected by the transfer sheet P1 or other transfer sheets such as the transfer sheet P2.

In particular, in the image forming system according to the present embodiment, the target conveyance speed is different for each device (module). Specifically, the target conveyance speed is set higher in the order of the reading device 50, the cooling device 40, and the fixing device 30. Therefore, for example, when the succeeding transfer sheet P2 sandwiched in the nip between the fixing belt 33 and the pressure roller 34 of the fixing device 30 is also sandwiched in the nip of the cooling belts 41 and 42 of the cooling device 40, the conveyance speed of the cooling belts 41 and 42 of the cooling device 40 is lower than the target conveyance speed in the cooling device 40. As a result, the preceding transfer sheet P1 sandwiched between the cooling belts 41 and 42 is also pulled by the cooling belts 41 and 42, and the conveyance speed of the transfer sheet P1 in the reading device 50 becomes lower than the target conveyance speed in the reading device 50.

Then, the trailing edge of the succeeding transfer sheet P2 exits the nip between the fixing belt 33 and the pressure roller 34 of the fixing device 30. At that timing, the conveyance speed in the cooling device 40 abruptly returns to the target conveyance speed and further increases. As a result, the conveyance speed of the preceding transfer sheet P1 sandwiched between the cooling belts 41 and 42 abruptly increases, and the conveyance speed of the transfer sheet P1 in the reading device 50 also abruptly increases. In the image forming system according to the present embodiment, the target conveyance speed is set to be different for each device. In this case, while the transfer sheet P1 passes through the reading device 50, the conveyance speed of the transfer sheet P1 is likely to fluctuate abruptly and greatly at the timing at which the leading edge of the transfer sheet P1 or P2 enters a conveyor of the plurality of conveyors or the trailing edge of the transfer sheet P1 or P2 exits a conveyor of the plurality of conveyors.

Figure 6A:
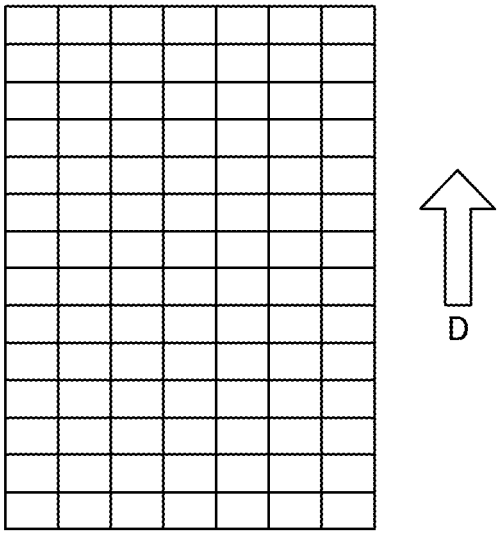
FIG. 6A is a schematic view illustrating an example of the print image actually formed on the transfer sheet.
Figure 6B:
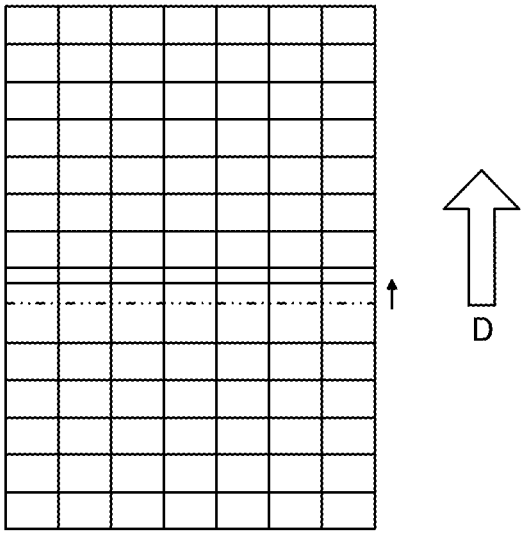
FIG. 6B is a schematic view illustrating an example of the read image represented on the transfer sheet, which is based on the read data when the conveyance speed of the transfer sheet fluctuates abruptly and greatly while the reading device reads the print image on the transfer sheet illustrated in FIG. 6A.

FIG. 6A is a schematic view illustrating an example of the print image actually formed on the transfer sheet P. FIG. 6B is a schematic view illustrating an example of the read image represented on the transfer sheet P. This read image is based on the read data when the conveyance speed of the transfer sheet P fluctuates abruptly and greatly while the reading device 50 reads the print image on the transfer sheet P illustrated in FIG. 6A.

If the conveyance speed of the transfer sheet P passing through the reading area fluctuates abruptly and greatly, some line intervals in the conveyance direction (sub-scanning direction) indicated by arrow D become wider or narrower in the read image based on the read data as illustrated in FIG. 6B. As a result, in the image defect detection, for example, an image defect, such as image stains or print misalignment, is erroneously detected based on the result that a certain line is detected at a position in the sub-scanning direction where no line should originally exist. Further, for example, an image defect such as image missing is erroneously detected based on the result that no line is detected at a position in the sub-scanning direction where a certain line should originally exist.

Figure 7A:
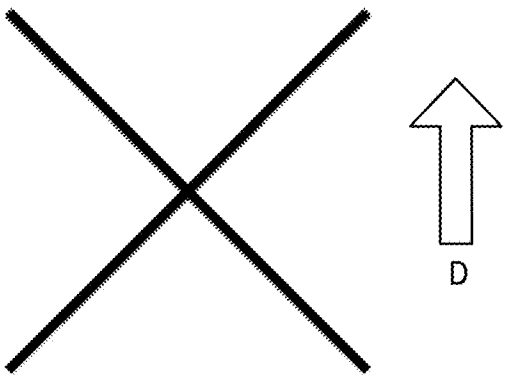
FIG. 7A is a schematic view illustrating another example of the print image actually formed on the transfer sheet P.
Figure 7B:
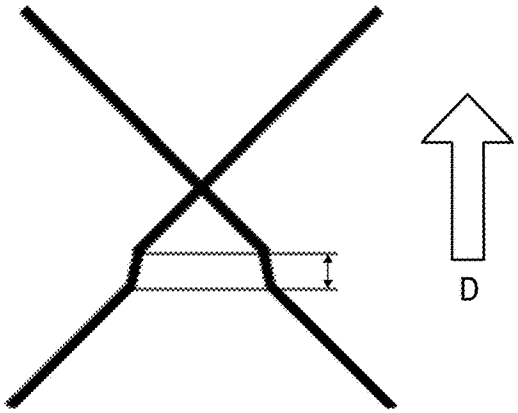
FIGS. 7B and 7C are schematic views illustrating another example of the read image represented on the transfer sheet, which is based on the read data when the conveyance speed of the transfer sheet fluctuates abruptly and greatly while the reading device reads the print image on the transfer sheet illustrated in FIG. 7A.
Figure 7C:
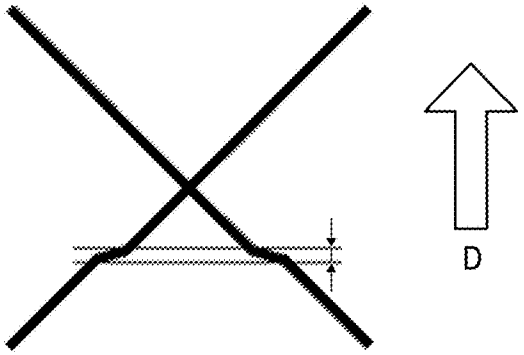

FIG. 7A is a schematic view illustrating another example of the print image actually formed on the transfer sheet P. FIGS. 7B and 7C are schematic views illustrating another example of the read image represented on the transfer sheet P. This read image is based on the read data when the conveyance speed of the transfer sheet P fluctuates abruptly and greatly while the reading device 50 reads the print image on the transfer sheet P illustrated in FIG. 7A.

If the conveyance speed of the transfer sheet P passing through the reading area fluctuates abruptly so as to slow down, a portion of the read image based on the read data stretches at a position corresponding to the abrupt speed fluctuation in the sub-scanning direction indicated by arrow D as illustrated in FIG. 7B. If the conveyance speed of the transfer sheet P passing through the reading area fluctuates abruptly so as to be faster, a portion of the read image based on the read data shrinks at a position corresponding to the abrupt speed fluctuation in the sub-scanning direction indicated by arrow D as illustrated in FIG. 7C. In these cases, an image defect called image distortion is erroneously detected in the image defect detection.

Therefore, in the present embodiment, a pattern image (hereinafter referred to as a "detection pattern") for detecting the large abrupt speed fluctuation described above is formed on the intermediate transfer belt 21. The detection pattern is transferred onto the transfer sheet P, and then, the reading device 50 reads the detection pattern on the transfer sheet P. Subsequently, a corrective processing is performed to correct the false detection of the image defect due to the abrupt speed fluctuation of the conveyance speed based on the read data read from the detection pattern.

Figure 8:
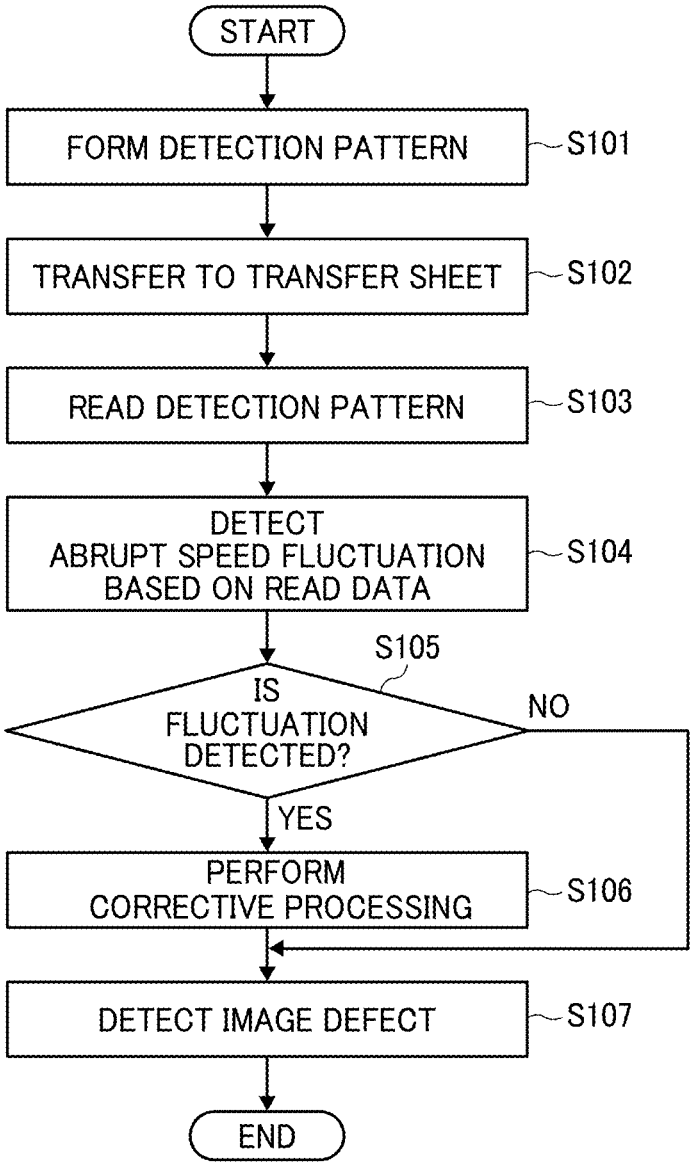
FIG. 8 is a flowchart of image defect detection according to an embodiment of the present disclosure.

FIG. 8 is a flowchart of the image defect detection according to the present embodiment. In the image defect detection according to the present embodiment, the controller 200 causes the image forming apparatus 100 to form the detection pattern with toner on the surface of the intermediate transfer belt 21 (S101). The image forming apparatus 100 uses a predetermined process and a configuration used in normal image forming process. The high voltage power source 24 applies the secondary transfer bias to the secondary transfer roller 23 to transfer the detection pattern on the surface of the intermediate transfer belt 21 onto the transfer sheet P (S102). The transfer sheet P to which the detection pattern has been transferred is conveyed to the reading device 50 via the fixing device 30 and the cooling device 40, similarly to the normal image forming process. The reading unit 51 of the reading device 50 reads the detection pattern on the transfer sheet P (S103). The read data of the detection pattern read by the reading device 50 is transmitted to the controller 200.

The controller 200 detects the abrupt speed fluctuation of the conveyance speed, which may occur in the read image, based on the read data of the detection pattern from the reading device 50 (S104). For example, when a line interval of the detection pattern based on the read data is out of the predetermined tolerance at a certain position, the controller 200 detects the abrupt speed fluctuation at the certain position.

Figure 9:
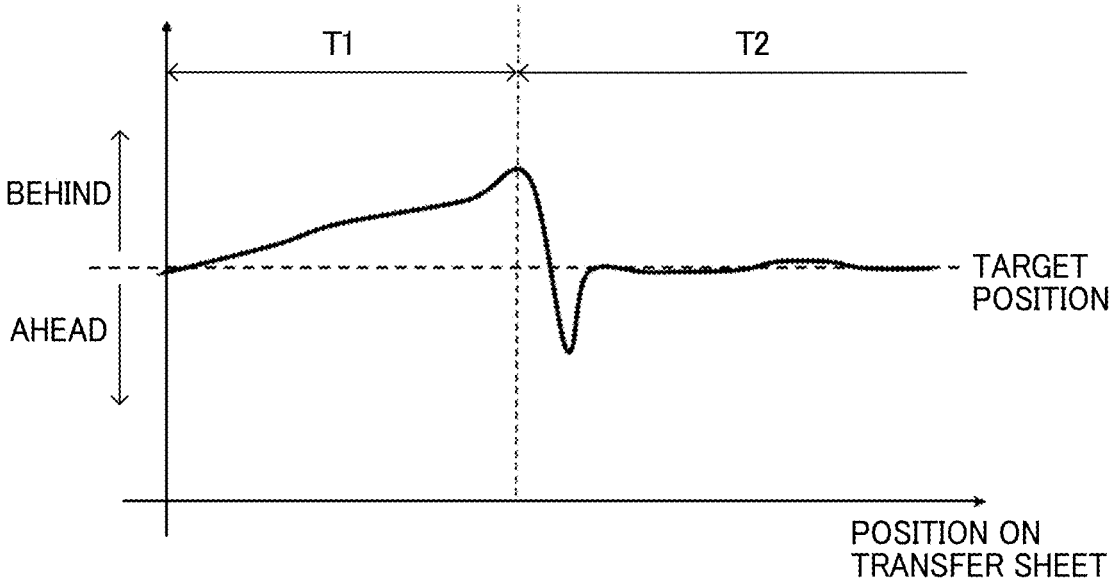
FIG. 9 is a graph illustrating an example of a deviation between a line at each position in the sub-scanning direction on the transfer sheet based on the read data of a detection pattern and the corresponding target position according to an embodiment of the present disclosure.

FIG. 9 is a graph illustrating an example of the deviation between the line of each position in the sub-scanning direction on the transfer sheet P based on the read data of the detection pattern and the corresponding target position according to the present embodiment.

As illustrated in FIG. 5, in the present embodiment, when the succeeding transfer sheet P2 sandwiched in the nip between the fixing belt 33 and the pressure roller 34 of the fixing device 30 is also sandwiched in the nip of the cooling belts 41 and 42 of the cooling device 40, the conveyance speed of the cooling belts 41 and 42 of the cooling device 40 is lower than the target conveyance speed in the cooling device 40. As a result, the preceding transfer sheet P1 sandwiched between the cooling belts 41 and 42 is also pulled by the cooling belts 41 and 42. In this period T1, as illustrated in FIG. 9, the conveyance speed of the transfer sheet P1 in the reading device 50 becomes lower than the target conveyance speed in the reading device 50. As a result, the transfer sheet P1 is behind the target position, and the deviation from the target position is progressively increased.

Then, the trailing edge of the succeeding transfer sheet P2 exits the nip between the fixing belt 33 and the pressure roller 34 of the fixing device 30. At that time when switching from the period T1 to the period T2 in FIG. 9, the conveyance speed in the cooling device 40 abruptly returns to the target conveyance speed and further increases. Accordingly, the conveyance speed of the preceding transfer sheet P1 sandwiched between the cooling belts 41 and 42 abruptly increases, and the conveyance speed of the transfer sheet P1 in the reading device 50 also abruptly increases. As a result, the transfer sheet P1 is temporarily ahead of the target position, and the deviation from the target position increases. However, the moving speeds of the first reading conveyance roller pair 55 and the second reading conveyance roller pair 56 are adjusted to the target speed, thereby reducing the deviation from the target position.

In the example in FIG. 9, at the time of the abrupt speed fluctuation immediately after the trailing edge of the succeeding transfer sheet P2 exits the nip between the fixing belt 33 and the pressure roller 34 of the fixing device 30, a line interval of the detection pattern based on the read data is out of the predetermined tolerance. Accordingly, the abrupt speed fluctuation at the corresponding position is detected.

The detection pattern is not limited as long as the abrupt speed fluctuation is detectable. Preferably, the detection pattern includes, for example, a plurality of lines extending in the main scanning direction are arranged at equal intervals in the sub-scanning direction (conveyance direction) as illustrated in FIG. 3A. In particular, when such a detection pattern is used, the fluctuation of the sub-scanning magnification is detectable based on the result obtained by the reading device 50 in addition to the abrupt speed fluctuation. Therefore, such a detection pattern is available for correcting the fluctuation of the sub-scanning magnification.

In the case of such a detection pattern, when the abrupt speed fluctuation occurs, the controller 200 detects that, for example, the line interval E3" is wider than the predetermined tolerance as illustrated in FIG. 4B, or the line interval E6" is narrower than the predetermined tolerance as illustrated in FIG. 4B in the detection pattern represented on the transfer sheet P based on the read data. When such a line interval out of the predetermined tolerance is detected, the controller 200 determines that the abrupt speed fluctuation has been detected (Yes in S105) and performs a corrective processing to correct the false detection of the image detect due to the abrupt speed fluctuation (S106).

Specifically, in the corrective processing, for example, the detection result of the abrupt speed fluctuation is stored in the memory of the controller 200. When the reading device 50 reads the print image on the transfer sheet P, the controller 200 adjusts the moving speeds of the first reading conveyance roller pair 55 and the second reading conveyance roller pair 56 of the reading device 50 at the timing when the abrupt speed fluctuation occurs based on the detection result stored in the memory to cancel the abrupt speed fluctuation.

In another corrective processing, for example, the detection result of the abrupt speed fluctuation is stored in the memory of the controller 200. The controller 200 performs magnification processing in the sub-scanning direction on the portion of the read image corresponding to the abrupt speed fluctuation based on the detection result stored in the memory to correct the image distortion that is a stretched portion or shrunk portion in the read image obtained by the reading device 50. Then, controller 200 compares the corrected read image with the master image. Alternatively, instead of the read image, the controller 200 can perform the magnification processing on the master image for the correction.

In yet another corrective processing, for example, the detection result of the abrupt speed fluctuation is stored in the memory of the controller 200. When the reading device 50 reads the print image on the transfer sheet P, the controller 200 including a read timing adjuster adjusts read timing (read cycle) of the reading unit 51 of the reading device 50 based on the detection result stored in the memory to cancel the stretch and shrink of the read image due to the abrupt speed fluctuation.

In still yet another corrective processing, for example, the detection result of the abrupt speed fluctuation is stored in the memory of the controller 200. When the controller 200 compares the read image obtained by the reading device 50 with the master image, the controller 200 reduces an effect of the portion of the read image corresponding to the abrupt speed fluctuation (i.e., the stretch and shrink of the read image) on the comparison result based on the detection result stored in the memory to correct the image distortion that is the stretched portion or shrunk portion in the read image obtained by the reading device 50. For example, when the controller 200 performs a matching process of comparing the read image obtained by the reading device 50 with the master image for each predetermined search range, the controller 200 including a search range adjuster sets (adjusts) the search range including the portion of the read image corresponding to the abrupt speed fluctuation relatively wide to reduce the effect of the portion of the read image corresponding to the abrupt speed fluctuation on the result of the matching process.

On the other hand, when the abrupt speed fluctuation is not detected (No in S105), the controller 200 does not perform the corrective processing, and directly compares the read image with the master image to detect the image defect (S107). When the image defect detector of the controller 200 detects an image defect, in the image defect treatment, for example, the controller 200 reports to a user that the image defect has occurred and prompts the user to eliminate the cause of the image defect.

The large abrupt speed fluctuation that occurs while the transfer sheet P passes through the reading area of the reading device 50 depends on the characteristics of the transfer sheet P (e.g., thickness, stiffness, smoothness of the transfer sheet P) or size of the transfer sheet P. Therefore, preferably, the detection result of the abrupt speed fluctuation obtained by reading the detection pattern with the reading device 50 is stored in the memory of the controller 200 for each sheet data such as the characteristics and size of the transfer sheet P used for the detection. Thus, by storing the detection result of the abrupt speed fluctuation in the memory for each sheet data, the controller 200 can performs the corrective processing using the detection result of the abrupt speed fluctuation for each sheet data corresponding to the transfer sheet P to be used. Therefore, the controller 200 can more appropriately correct the false detection of the image defect.

A description is given below of an example of variation of the image defect detection according to the above-described embodiments (hereinafter, referred to as a first variation). In the above-described embodiments, only the detection pattern for detecting the abrupt speed fluctuation is formed on the transfer sheet P, and the reading device 50 reads the detection pattern. In the first variation, a different image other than the detection pattern is formed on the transfer sheet P, on which the detection pattern is also formed. The different image is used for a different purpose. The reading device 50 collectively reads the different image and the detection pattern.

The above-described different image is not limited to a peculiar image. In the first variation, for example, a parameter generation chart (test image) is formed on the transfer sheet P, on which the detection pattern is also formed to detect the abrupt speed fluctuation. The parameter generation chart is used for determining the conversion parameter.

As described above, when the controller 200 compares the master image with the read data, the conversion parameter is used for converting the original image data in the CMYK color space used as the master image to the image data in the RGB color space in which the read data is represented.

Figure 10:
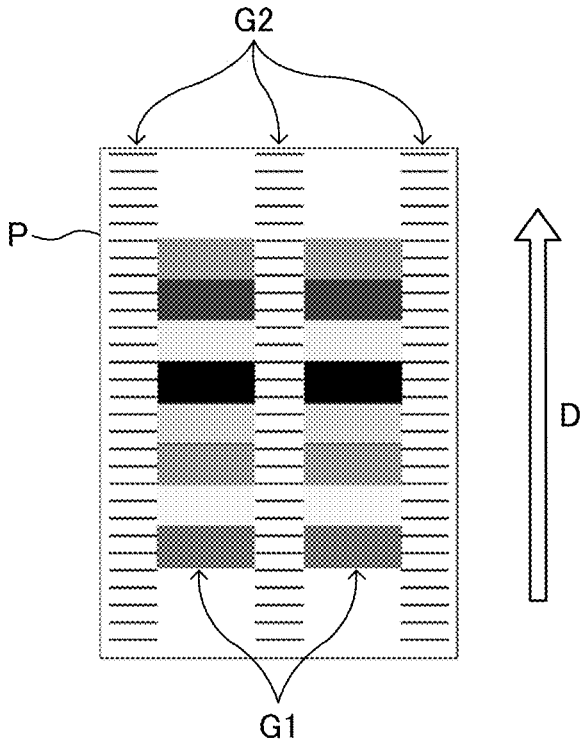
FIG. 10 is a schematic view illustrating an example of a parameter generation chart and the detection pattern according to a first variation.

FIG. 10 is a schematic view illustrating an example of a parameter generation chart G1 and a detection pattern G2 according to the first variation. The parameter generation chart G1 in the first variation includes a plurality of test patterns having different levels of colors and gradations, arranged in the sub-scanning direction. The reading unit 51 of the reading device 50 reads the parameter generation chart G1, and the controller 200 calculates the conversion parameter to convert the original image data in the CMYK color space to the image data in the RGB color space based on the read data of the parameter generation chart G1 by a known method.

The controller 200 stores the calculated conversion parameter in the memory. When comparing the read image based on the read data and the master image of the print data (i.e., the ideal image based on the original image data), the controller 200 reads the conversion parameter from the memory and uses the conversion parameter to convert the original image data in the CMYK color space to the image data in the RGB color space.

Since the tint of the print image varies depending on the characteristics of the transfer sheet P such as the color of the transfer sheet P, preferably, the controller 200 stores the conversion parameter in the memory for each sheet data. Thus, by storing the conversion parameter in the memory for each sheet data, the controller 200 can convert the original image data in the CMYK color space to the image data in the RGB color space using the suitable conversion parameter for each sheet data corresponding to the transfer sheet P to be used. Therefore, the controller 200 can more appropriately detect the image defect.

Figure 11:
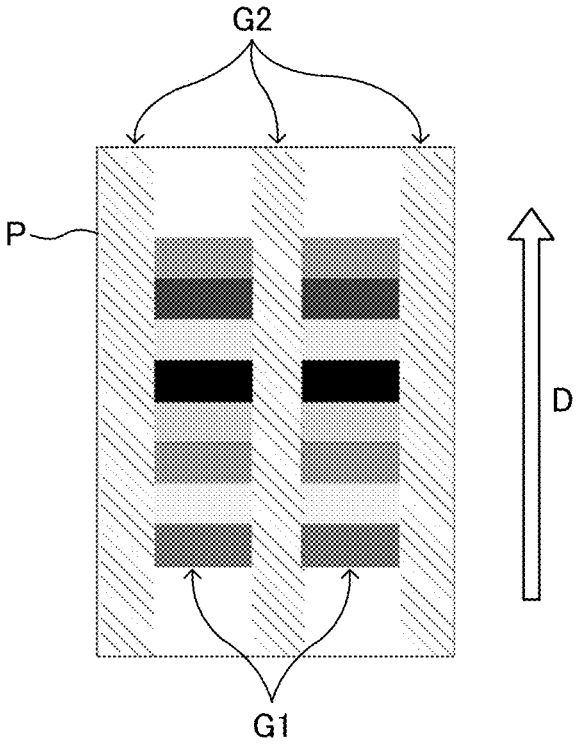
FIG. 11 is a schematic view illustrating another example of the parameter generation chart and the detection pattern according to the first variation.

As illustrated in FIG. 10, the detection pattern G2 in the first variation includes a ladder pattern in which a plurality of lines extending in the main scanning direction is arranged at equal intervals in the sub-scanning direction (i.e., the conveyance direction indicated by arrow D in FIG. 10). Alternatively, the detection pattern G2 includes, for example, as illustrated in FIG. 11, a pattern in which a plurality of lines extending in a direction inclined with respect to the main scanning direction is arranged at equal intervals in the sub-scanning direction (i.e., the conveyance direction indicated by arrow D in FIG. 11).

A description is given below of an example of another variation of the image defect detection according to the above-described embodiments (hereinafter, referred to as a second variation). In the second variation, similarly to the first variation described above, another different image different from the detection pattern is formed on the transfer sheet P, on which the detection pattern is also formed. The reading device 50 collectively reads the different image and the detection pattern. The second variation is different from the first variation described above in that the different image is a user image.

Figure 12A:
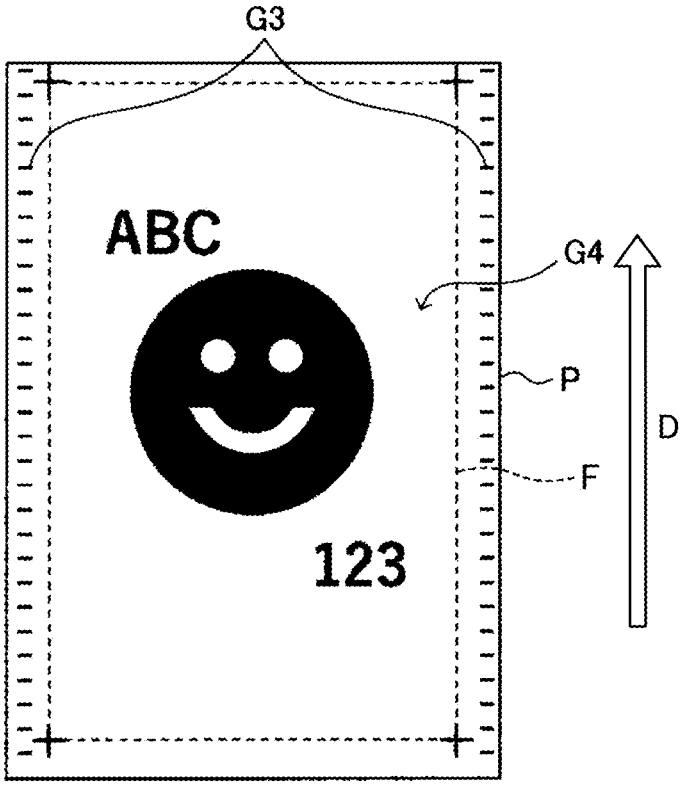
FIGS. 12A and 12B are schematic views illustrating an example of a user image and the detection pattern according to a second variation.
Figure 12B:
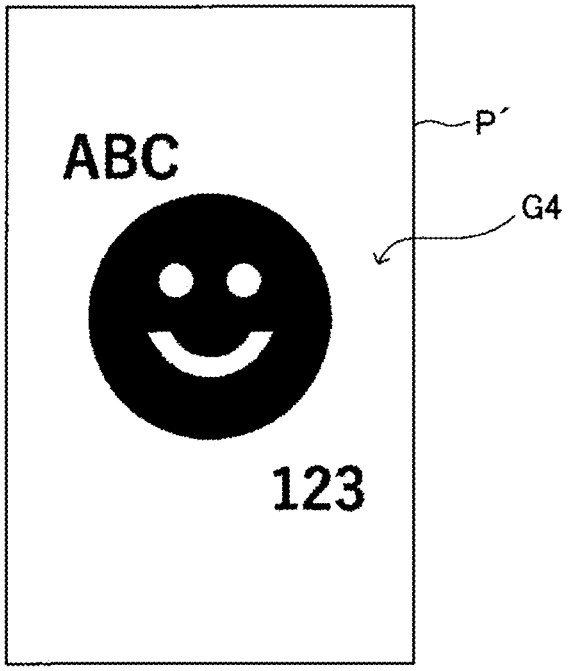

FIGS. 12A and 12B are schematic views illustrating an example of a detection pattern G3 and a user image G4 according to the second variation. The user image G4 in the second variation is an image including a picture or a character designated by the user, and the transfer sheet P on which the user image G4 is formed is provided to the user as a printed matter. On the other hand, similarly to the detection pattern G2 in the first variation illustrated in FIG. 10, the detection pattern G3 in the second variation includes a ladder pattern in which a plurality of lines extending in the main scanning direction is arranged at equal intervals in the sub-scanning direction (i.e., the conveyance direction indicated by arrow D in FIG. 12A). Similarly to the above-described first variation, the detection pattern G3 can include, for example, a pattern in which a plurality of lines extending in a direction inclined with respect to the main scanning direction is arranged at equal intervals in the sub-scanning direction (conveyance direction) as illustrated in FIG. 11.

In the second variation, a cutting device is disposed between the reading device 50 and the sheet ejection device 60. FIG. 12A illustrates the transfer sheet P passing through the reading device 50 before cutting. The cutting device cuts the transfer sheet P along a cutting line F. As a result, a transfer sheet P' illustrated in FIG. 12B in which the outside from the cutting line F has been cut off is conveyed to the sheet ejection device 60 as a final printed matter. The detection pattern G3 in the second variation is formed on the outside from the cutting line F and does not remain in the final printed matter. Therefore, in the second variation, the detection pattern G3 can be formed on the same transfer sheet P on which the user image G4 is formed.

Figure 13:
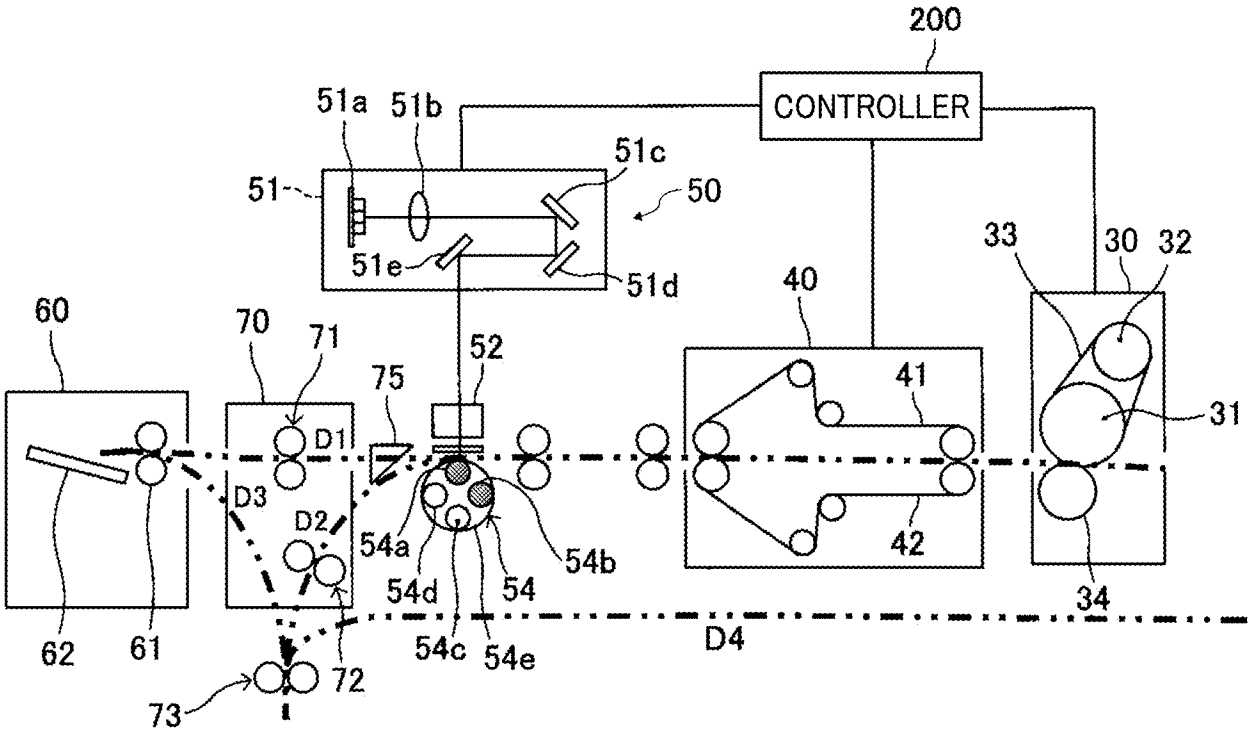
FIG. 13 is a schematic view illustrating a configuration of a part of an image forming system according to a third variation.

A description is given below of an example of a variation of the image forming system according to the above-described embodiment (hereinafter, referred to as a third variation). FIG. 13 is a schematic view illustrating a configuration of a part of an image forming system according to the third variation. The image forming system according to the third variation includes a decurler device 70 disposed between the reading device 50 and the sheet ejection device 60 in the above-described embodiment.

The decurler device 70 in the third variation includes a decurler relay roller pair 71, a decurler reverse roller pair 72, a reverse roller pair 73, and a path switching section 75. The transfer sheet P that has passed through the reading device 50 is sent to either the decurler relay roller pair 71 or the decurler reverse roller pair 72 by the path switching section 75 under the control of the controller 200.

The transfer sheet P sent to the decurler relay roller pair 71 advances substantially straight in the decurler device 70 and enters the decurler relay roller pair 71 in a conveyance path D1 as illustrated in FIG. 13. Then, the transfer sheet P is sent to the output roller pair 61 of the sheet ejection device 60.

The transfer sheet P sent to the decurler reverse roller pair 72 is conveyed downward in a conveyance path D2 as illustrated in FIG. 13 in the decurler device 70 by the path switching section 75 and enters the decurler reverse roller pair 72. Then, the transfer sheet P is sent to the reverse roller pair 73 that is rotatable in the forward and reverse directions. The reverse roller pair 73 rotates in the forward direction to convey the transfer sheet P by a predetermined distance, and then rotates in the reverse direction to reverse the conveyance direction of the transfer sheet P in a switchback. The transfer sheet P passing through the switchback is conveyed in a conveyance path D3 as illustrated in FIG. 13 to the output roller pair 61 of the sheet ejection device 60. As a result, the transfer sheet P with the front and back faces reversed is ejected to the sheet ejection device 60.

In the third variation, as the conveyance direction is switched from the conveyance path D2 to a reverse conveyance path D4 illustrated in FIG. 13, the transfer sheet P passing through the switched back is sent to the reverse conveyance path D4. The transfer sheet P conveyed through the reverse conveyance path D4 is again sent to the secondary transfer roller 23 of the image forming apparatus 100, and a toner image on the intermediate transfer belt 21 is secondarily transferred to the back face of the transfer sheet P. Thus, the transfer sheet P bearing the toner images on both sides thereof is ejected to the sheet ejection device 60.

In the third variation, the image forming system satisfies relations of $L2<L1$ and $L3<L1$, where L1 represent the length of the transfer sheet P in the conveyance direction, L2 represents the conveyance distance from the reading position where the reading device 50 reads the detection pattern to the decurler relay roller pair 71, and L3 represents the conveyance distance from the reading position to the decurler reverse roller pair 72. As described above, since the conveyance distances L2 and L3 from the reading position to the decurler relay roller pair 71 and the decurler reverse roller pair 72 is short, the reading device 50 and the decurler device 70 can be downsized, and the entire image forming system can also be downsized.

However, in this case, at the timing when the leading edge of the transfer sheet P enters the decurler relay roller pair 71 or the decurler reverse roller pair 72 of the decurler device 70, the reading device 50 is still reading the detection pattern of the transfer sheet P. In this case, although a large abrupt speed fluctuation of the transfer sheet P occurs while the reading device 50 reads the detection pattern, the image forming system in the third variation can detect the large abrupt speed fluctuation.

In the above-described embodiments including the first to third variations, the reading device 50 can read an image on a transfer sheet P having a size (length in the sub-scanning direction) different from the example illustrated in FIG. 2, for example, a small size or large size transfer sheet. The image forming system according to the above-described embodiments is applied to the transfer sheet P of a certain size that is simultaneously conveyed by at least two of a plurality of conveyors, but all the transfer sheets used in the image forming system is not limited thereto.

In the above-described embodiments, a conveyor that causes an abrupt speed fluctuation of the transfer sheet P being read by the reading device 50 includes a conveyor in a device (module) different from the reading device 50. However, the different device and the reading device 50 can be combined as a single device.

The embodiments described above are examples and can provide, for example, the following effects, respectively.

Aspect 1

According to Aspect 1, the conveyance apparatus includes a plurality of conveyors and an image reader. The plurality of conveyors, such as the fixing belt 33 and the pressure roller 34 of the fixing device 30, the cooling belts 41 and 42 of the cooling device 40, the first and second reading conveyance roller pairs 55 and 56 of the reading device 50, and the output roller pair 61 of the sheet ejection device 60, conveys a recording material, such as the transfer sheet P1. The image reader such as the reading unit 51 reads a pattern image such as the detection pattern on the recording material being conveyed. The conveyance apparatus further includes circuitry such as the controller 200. The circuitry controls the image reader to read the pattern image on the recording material in a period including a timing at which a trailing edge of the recording material such as the transfer sheet P1 being conveyed by at least two of the plurality of conveyors exits an upstream conveyor among the at least two of the plurality of conveyors in a direction of conveyance of the recording material. The upstream conveyor includes, for example, the fixing belt 33 and the pressure roller 34 of the fixing device 30, the cooling belts 41 and 42 of the cooling device 40, and the first reading conveyance roller pair 55 of the reading device 50.

In Aspect 1, the read data of the pattern image can be obtained, which is read at the timing at which the trailing edge of the recording material exits an upstream conveyor among the at least two of the plurality of conveyors conveying the recording material in the direction of conveyance of the recording material. Therefore, conveyance speed fluctuation can be detected when the conveyance force or conveyance load applied to the recording material varies at the timing based on the read data of the pattern image. Therefore, the conveyance speed fluctuation can be detected at the timing at which the period is switched from when the recording material is conveyed by at least two of the plurality of conveyors to when the recording material is conveyed only by a downstream conveyor among the at least two of the plurality conveyors in the direction of conveyance of the recording material. That is, the timing is when the trailing edge of the recording material exits the upstream conveyor among the as least two of the plurality of conveyors conveying the recording material in the direction of conveyance of the recording material.

In particular, in a configuration in which the plurality of conveyors is provided in different devices disposed, for example, between the image forming apparatus and the post-processing or pre-processing apparatus, the drive system of each of the plurality of conveyors is independent of each other. Therefore, the conveyance force or the conveyance load is likely to fluctuate greatly at the timing when the trailing edge exits the upstream conveyor conveying the recording material in the direction of conveyance of the recording material. Therefore, with this configuration according to Aspect 1, more advantageous effects are attained.

Aspect 2

According to Aspect 2, the conveyance apparatus includes a plurality of conveyors and an image reader. The plurality of conveyors, such as the fixing belt 33 and the pressure roller 34 of the fixing device 30, the cooling belts 41 and 42 of the cooling device 40, the first and second reading conveyance roller pairs 55 and 56 of the reading device 50, and the output roller pair 61 of the sheet ejection device 60, conveys recording materials (e.g., the transfer sheets P, P1, and P2) including a preceding recording material (e.g., the transfer sheet P1) and a succeeding recording material (e.g., the transfer sheet P2) following the preceding recording material. The image reader such as the reading unit 51 reads a pattern image such as the detection pattern on the preceding recording material being conveyed. The conveyance apparatus further includes circuitry such as the controller 200. The circuitry controls the image reader to read the pattern image on the preceding recording material such as the transfer sheet P1 in a period including a timing at which a trailing edge of the succeeding recording material such as the transfer sheet P2 that is simultaneously being conveyed together with the preceding recording material by one of the plurality of conveyors, exits an upstream conveyor from the one of the plurality of conveyors in a direction of conveyance of the recording materials. The upstream conveyor includes, for example, the fixing belt 33 and the pressure roller 34 of the fixing device 30.

In Aspect 2, the read data of the pattern image can be obtained, which is read at the timing at which the trailing edge of the succeeding recording material exits an upstream conveyor from the one of the plurality of conveyors conveying the succeeding recording material in the direction of conveyance of the recording materials. Therefore, conveyance speed fluctuation can be detected when the conveyance force or conveyance load applied to the preceding recording material varies at the timing based on the read data of the pattern image. Therefore, the conveyance speed fluctuation can be detected at the timing at which the period is switched from when the succeeding recording material is conveyed by the one of the plurality of conveyors and the upstream conveyor to when the succeeding recording material is conveyed only by the one of the plurality conveyors in the direction of conveyance of the recording materials. That is, the timing is when the trailing edge of the succeeding recording material exits the upstream conveyor from the one of the plurality of conveyors conveying the succeeding recording material in the direction of conveyance of the recording materials.

In particular, in a configuration in which the plurality of conveyors is provided in different devices disposed, for example, between the image forming apparatus and the post-processing or pre-processing apparatus, the drive system of each of the plurality of conveyors is independent of each other. Therefore, the conveyance force or the conveyance load is likely to fluctuate greatly at the timing when the trailing edge exits the upstream conveyor conveying the succeeding recording material in the direction of conveyance of the recording materials. Therefore, with this configuration according to Aspect 2, more advantageous effects are attained.

Aspect 3

According to Aspect 3, the conveyance apparatus includes a plurality of conveyors and an image reader. The plurality of conveyors, such as the fixing belt 33 and the pressure roller 34 of the fixing device 30, the cooling belts 41 and 42 of the cooling device 40, the first and second reading conveyance roller pairs 55 and 56 of the reading device 50, and the output roller pair 61 of the sheet ejection device 60, conveys a recording material, such as the transfer sheet P1. The image reader such as the reading unit 51 reads a pattern image such as the detection pattern on the recording material being conveyed. The conveyance apparatus further includes circuitry such as the controller 200. The circuitry controls the image reader to read the pattern image on the recording material in a period including a timing at which a leading edge of the recording material such as the transfer sheet P1 being conveyed by at least one of the plurality of conveyors enters a downstream conveyor from the at least one of the plurality of conveyors in a direction of conveyance of the recording material. The downstream conveyor includes, for example, the cooling belts 41 and 42 of the cooling device 40, the first and second reading conveyance roller pairs 55 and 56 of the reading device 50, and the output roller pair 61 of the sheet ejection device 60.

In Aspect 3, the read data of the pattern image can be obtained, which is read at the timing at which a leading edge of the recording material enters a downstream conveyor from the at least one of the plurality of conveyors conveying the recording material in the direction of conveyance of the recording material. Therefore, conveyance speed fluctuation can be detected when the conveyance force or conveyance load applied to the recording material varies at the timing based on the read data of the pattern image. Therefore, the conveyance speed fluctuation can be detected at the timing at which the period is switched from when the recording material is conveyed only by the at least one of the plurality of conveyors in the direction of conveyance of the recording material to when the recording material is conveyed by the at least one of the plurality of conveyors and the downstream conveyor. That is, the timing is when the leading edge of the recording material enters the downstream conveyor from the at least one of the plurality of conveyors conveying the recording material in the direction of conveyance of the recording material.

In particular, in a configuration in which the plurality of conveyors is provided in different devices disposed, for example, between the image forming apparatus and the post-processing or pre-processing apparatus, the drive system of each of the plurality of conveyors is independent of each other. Therefore, the conveyance force or the conveyance load is likely to fluctuate greatly at the timing when the leading edge enters the downstream conveyor from the at least one of the plurality of conveyors conveying the recording material in the direction of conveyance of the recording material. Therefore, with this configuration according to Aspect 3, more advantageous effects are attained.

Aspect 4

According to Aspect 4, the conveyance apparatus according to any one of Aspects 1 or 3 further includes a read timing adjuster such as the controller 200 to adjust a timing at which the image reader reads the pattern image based on conveyance speed fluctuation data obtained from read data of the pattern image.

In the read data of the pattern image read by the image reader, the image stretch or shrink that does not originally exist is generated at a portion of the pattern image read at the timing at which the above-described conveyance speed fluctuation occurs. Therefore, the read data can be obtained so as not to generate the image stretch or shrink that does not originally exist because the read timing adjuster adjusts the timing at which the image reader reads the pattern image based on the conveyance speed fluctuation data obtained from the read data of such a pattern image.

Aspect 5

According to Aspect 5, in the conveyance apparatus according to any one of Aspects 1 to 4, the upstream conveyor includes a fixing conveyor, such as the fixing belt 33 and the pressure roller 34 of the fixing device 30 to fix the pattern image on the recording material.

In Aspect 5, the large abrupt speed fluctuation is detected, which occurs at the timing at which the trailing edge of the recording material or the succeeding recording material exits, for example, the fixing conveyor of the fixing device 30. As a result, the target image can be appropriately processed.

Aspect 6

According to Aspect 6, in the conveyance apparatus according to any one of Aspects 1 to 4, the downstream conveyor includes a cooling conveyor, such as the cooling belts 41 and 42 of the cooling device 40 to cool the recording material.

In Aspect 5, the large abrupt speed fluctuation is detected, which occurs at the timing at which the leading edge of the succeeding recording material enters, for example, the cooling conveyor of the cooling device 40. As a result, the target image can be appropriately processed.

Aspect 7

According to Aspect 7, an image defect detection device, such as the device constructed of the controller 200 and the reading device 50, includes an image defect detector such as the controller 200 to detect an image defect of a target image formed on the recording material, and the conveyance apparatus according to any one of Aspects 1 to 6. The image reader reads the target image on the recording material and the pattern image on the recording material. The image defect detector detects the image defect of the target image based on read data of the target image, using conveyance speed fluctuation data obtained from read data of the pattern image.

When the above-described conveyance speed fluctuation occurs during the period when the image reader reads the target image on the recording material, incorrect data may be included in the read data of the target image, resulting in false detection of the image defect of the target image. According to Aspect 7, even when the above-described conveyance speed fluctuation occurs during the period in which the image reader reads the target image on the recording material, the conveyance speed fluctuation can be detected. Therefore, the image defect detection device can correct the false detection of the image defect of the target image.

Aspect 8

According to Aspect 8, in the image defect detection device according to Aspect 7, the image defect detector converts an original image data, for example, in the CMYK color space for forming the target image to a converted image data corresponding to a color space (e.g., the RGB color space) of the read data of the target image, compare the converted image data and the read data of the target image, and detect the image defect of the target image.

According to Aspect 8, even if the original image data and the read data of the target image are in different color spaces, the image defect detection device can compare the converted image data and the read data of the target image and detect the image defect of the target image.

Aspect 9

According to Aspect 9, the image defect detection device according to Aspect 7 or 8 further includes a search range adjuster such as the controller 200 to adjust a predetermined search range based on the conveyance speed fluctuation data obtained from the read data of the pattern image. The image defect detector compares an original image data for forming the target image or the converted image data corresponding to a color space of the read data of the target image with the read data of the target image in each predetermined search range.

According to Aspect 9, when the image defect detection device performs the matching process of comparing the read image read by the image reader with the original image data for each predetermined search range, the image defect detection device sets (adjusts) the search range including the portion of the read image corresponding to the above-described abrupt speed fluctuation relatively wide to reduce the effect of the image portion on the result of the matching process. Therefore, the image defect detection device can correct the false detection of the image defect of the target image.

Aspect 10

According to Aspect 10, an image forming system includes an image forming apparatus such as the image forming apparatus 100 to form the target image such as the print image on the recording material, and the image defect detection device according to any one of Aspects 7 to 9.

According to Aspect 10, even when the above-described conveyance speed fluctuation occurs during the period in which the image reader reads the target image on the recording material, the conveyance speed fluctuation can be detected. Therefore, the image forming system can be provided in which the image defect detection device can correct the false detection of the image defect of the target image.

Aspect 11

According to Aspect 11, in the image forming system according to Aspect 10, the image reader reads a test image such as the parameter generation chart G1 formed on the recording material by the image forming apparatus 100. The image defect detector converts an original image data for forming the target image to a converted image data corresponding to a color space of the read data of the target image, compare the converted image data and the read data of the target image, and detect the image defect of the target image. Further, the image defect detector acquires a conversion parameter for converting the original data based on read data of the test image.

According to Aspect 11, since the conversion parameter suitable for usage environment can be appropriately acquired, even if the original image data and the read data of the target image are in different color spaces, the image defect detection device can compare the converted image data and the read data of the target image and detect the image defect of the target image.

Aspect 12

According to Aspect 12, in the image forming system according to Aspect 11, the image forming apparatus 100 forms the pattern image on the recording material on which the test image is also formed.

According to Aspect 12, the total time for reading both of the test image and the pattern image can be shortened and the number of recording materials to be used can be reduced as compared with the case in which the test image and the pattern image are formed on different recording materials.

Aspect 13

According to Aspect 13, in the image forming system according to any one of Aspects 10 to 12, the image defect detector controls the plurality of conveyors such as the first and second reading conveyance roller pairs 55 and 56 so as to reduce conveyance speed fluctuation.

According to Aspect 13, the image forming system can reduce the conveyance speed fluctuation of the recording material that occurs during the reading of the recording material on which the target image is formed by controlling the plurality of conveyors. Therefore, the image forming system can reduce false data included in the read data of the target image and prevent false detection of the image defect of the target image.

Aspect 14

According to Aspect 14, in the image forming system according to any one of Aspects 10 to 12, the image defect detector generates an image correction parameter based on the conveyance speed fluctuation data and detect the image defect of the target image based on the image correction parameter.

According to Aspect 14, even when the above-described conveyance speed fluctuation occurs on the recording material during the reading of the recording material on which the target image is formed, the image forming system can correct the read data of the target image or the original image data to be compared with the read data regarding the image portion (i.e., the stretched portion or the shrunk portion) corresponding to the conveyance speed fluctuation based on the image correction parameter. Therefore, the image forming system can correct the false detection of the image defect of the target image.

Aspect 15

According to Aspect 15, in the image forming system according to any one of Aspects 10 to 14, the image defect detector acquires recording material data and detects the image defect of the target image based on the recording material data.

The thickness or the stiffness of the recording material affect the above-described conveyance speed fluctuation. According to Aspect 15, the image forming system can prevent the false detection of the image defect of the target image because the image defect detector acquires the recording material data such as the thickness or the stiffness of the recording material that affect the above-described conveyance speed fluctuation to detect the image defect of the target image.

The tint of the recording material also affects the above-described conversion parameter. According to Aspect 15, the image forming system can prevent the false detection of the image defect of the target image because the image defect detector acquires the recording material data such as the tint of the recording material that affect the above-described conversion parameter to detect the image defect of the target image.

Aspect 16

According to Aspect 16, an image forming system includes an image forming apparatus such as the image forming apparatus 100 to form the target image such as the print image on the recording material, and the conveyance apparatus according to any one of Aspects 1 to 6.

According to Aspect 16, even when the above-described conveyance speed fluctuation occurs during the period in which the image reader reads the target image on the recording material, the conveyance speed fluctuation can be detected. Therefore, the image forming system can be provided in which the false detection of the image defect of the target image can be detected.

In the above described embodiments, the controller 200 is implemented by circuitry including the image defect detector, the read timing adjuster, the search range adjuster, and the like.

As described above, according to the present disclosure, a large abrupt speed fluctuation can be detected, which occurs at the timing, for example, at which a trailing edge of the recording material being conveyed by at least two of the plurality of conveyors exits an upstream conveyor among the at least two of the plurality of conveyors in a direction of conveyance of the recording material. As a result, the target image can be appropriately processed base on the detection result.

The above-described embodiments are illustrative and do not limit the present disclosure. Thus, numerous additional modifications and variations are possible in light of the above teachings. For example, elements and/or features of different illustrative embodiments may be combined with each other and/or substituted for each other within the scope of the present disclosure.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), DSP (digital signal processor), FPGA (field programmable gate array) and conventional circuit components arranged to perform the recited functions.

Any one of the above-described operations may be performed in various other ways, for example, in an order different from the one described above.

What is claimed is:

1. A conveyance apparatus comprising:

a plurality of conveyors configured to convey a recording material;

an image reader configured to read a pattern image on the recording material being conveyed; and circuitry configured to control the image reader to read the pattern image on the recording material in a period including a timing at which a trailing edge of the recording material being conveyed by at least two of the plurality of conveyors exits an upstream conveyor among the at least two of the plurality of conveyors in a direction of conveyance of the recording material, wherein the circuitry is configured to detect an image defect using conveyance speed fluctuation data obtained from read data of the pattern image, and wherein the circuitry is configured to adjust the timing at which the image reader reads the pattern image based on the conveyance speed fluctuation data obtained from the read data of the pattern image.

2. The conveyance apparatus according to claim 1, wherein the circuitry is configured to control the image reader to read a target image formed on the recording material, and wherein the circuitry is configured to detect the image defect of the target image based on read data of the target image.

3. The conveyance apparatus according to claim 2, wherein the circuitry is configured to:

convert original image data for forming the target image to converted image data corresponding to a color space of the read data of the target image;

compare the converted image data and the read data of the target image; and detect the image defect of the target image.

4. The conveyance apparatus according to claim 2, wherein the circuitry is configured to:

adjust a predetermined search range based on the conveyance speed fluctuation data obtained from the read data of the pattern image; and compare original image data for forming the target image or converted image data corresponding to a color space of the read data of the target image with the read data of the target image in each predetermined search range.

5. An image forming system comprising:

an image forming apparatus configured to form the target image on a recording material, and the conveyance apparatus according to claim 2.

6. The image forming system according to claim 5, wherein the image forming apparatus is configured to form a test image on the recording material, wherein the image reader is configured to read the test image, and wherein the circuitry is configured to:

convert original image data for forming the target image to converted image data corresponding to a color space of the read data of the target image;

compare the converted image data and the read data of the target image;

detect the image defect of the target image; and acquire a conversion parameter for converting the original image data based on read data of the test image.

7. The image forming system according to claim 6, wherein the image forming apparatus is configured to form the pattern image on the recording material on which the test image is also formed.

8. The image forming system according to claim 5, wherein the circuitry is configured to control the plurality of conveyors to reduce conveyance speed fluctuation.

9. The image forming system according to claim 5, wherein the circuitry is configured to generate an image correction parameter based on the conveyance speed fluctuation data and detect the image defect of the target image based on the image correction parameter.

10. The image forming system according to claim 5, wherein the circuitry is configured to acquire recording material data and detect the image defect of the target image based on the recording material data.

11. An image forming system comprising:

an image forming device configured to form a target image on a recording material, and the conveyance apparatus according to claim 1.

* * * * *